US009431738B2

(12) United States Patent
Akino

(10) Patent No.: US 9,431,738 B2
(45) Date of Patent: Aug. 30, 2016

(54) MICROPHONE CONNECTOR

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/671,287

(22) Filed: Mar. 27, 2015

(65) Prior Publication Data

US 2015/0333429 A1 Nov. 19, 2015

(30) Foreign Application Priority Data

May 15, 2014 (JP) ..... 2014-101094

(51) Int. Cl.

| | |
|---|---|
| ***H01R 13/40*** | (2006.01) |
| ***H01R 13/04*** | (2006.01) |
| ***H01R 13/422*** | (2006.01) |
| ***H01R 24/38*** | (2011.01) |
| ***H01R 43/04*** | (2006.01) |

(52) U.S. Cl.

CPC ..... *H01R 13/04* (2013.01); *H01R 13/422* (2013.01); *H01R 24/38* (2013.01); *H01R 43/04* (2013.01); *Y10T 29/49176* (2015.01)

(58) Field of Classification Search

CPC ..... H01R 13/719; H01R 13/66; H01R 19/04

USPC ..... 439/733.1, 625; 381/355

See application file for complete search history.

(56) References Cited

U.S. PATENT DOCUMENTS

| | | | | |
|---|---|---|---|---|
| 4,187,481 A * | 2/1980 | Boutros | ..... | H01R 13/7197 333/182 |
| 8,366,488 B2 * | 2/2013 | Akino | ..... | H01R 13/7195 439/607.55 |

FOREIGN PATENT DOCUMENTS

| | | |
|---|---|---|
| JP | 2005-94575 A | 4/2005 |
| JP | 2008-67341 A | 3/2008 |
| JP | 2008-141575 A | 6/2008 |
| JP | 2011-205179 A | 10/2011 |

* cited by examiner

*Primary Examiner* — Vanessa Girardi

(74) *Attorney, Agent, or Firm* — Whitham, Curtis & Cook, P.C.

(57) ABSTRACT

A connector of a microphone includes a cylindrical connector case 1 having openings at both ends and a projection 10 on an inner face thereof; two substrates 11 and 12 having shapes fittable to the inner face of the cylindrical connector case 1, the substrates 11 and 12 facing each other across the projection 10 in the cylindrical connector case 1; and a connector pin 2 extending through the substrates 11 and 12 in the cylindrical connector case 1, having a contact 21 that is electrically connected to electronic parts 16 mounted on the substrates 11 and 12, and having a caulked portion 23 fixed to one of the substrates 11 and 12 on an opposite side to the contact 21.

16 Claims, 6 Drawing Sheets

MICROPHONE CONNECTOR

TECHNICAL FIELD

The present invention relates to a connector of a microphone, the microphone, and a method for manufacturing the connector of the microphone.

BACKGROUND ART

A traditional connector of a microphone is assembled through the following processes. An internal assembly (pin insert) including connector pins and electronic parts is inserted into a cylindrical connector case. After this step, the connector case is tightened with screws toward the internal assembly from the exterior in the radial direction of the connector case. The internal assembly is fixed in the connector case through these processes.

In such a connector of a microphone, the connector case is tightened with screws toward the internal assembly from the exterior in the radial direction of the connector case; hence, the connector pins of the internal assembly are pulled in the axial directions of the screws.

As a result, the connector of the microphone may cause the eccentricity or rotation of the pin insert, leading to the displacement of the connector pins from a predetermined position. In this case, the traditional connector of the microphone causes no contact of the connector pins or no engagement in the connection between the male and female connectors.

A condenser microphone includes electronic circuits, such as a detecting unit (microphone unit) for detecting vibration of air, an impedance converter, or an output circuit, which include electronic parts.

Electric signals detected in the detecting unit have high impedance. In order to avoid the influence of noise, the impedance converter must convert high impedance electric signals into low impedance electric signals and efficiently output the signals.

For example, a microphone cord is exposed to strong electromagnetic waves to cause a high frequency current to flow into the microphone through the connector of the microphone. The flow of the high frequency current is detected by circuit elements in the electronic circuits to cause noise in audio signals.

Techniques are disclosed for preventing the eccentricity or rotation of a pin insert fit into a connector case in assembly processes of a microphone (for example, see Japanese Unexamined Patent Application Publications Nos. 2008-141575 (Patent Literature 1) and 2008-67341 (Patent Literature 2)).

Other techniques are disclosed for providing an electrostatic shield over a connector for prevention of noise in a condenser microphone (for example, see Japanese Unexamined Patent Application Publications Nos. 2005-094575 (Patent Literature 3) and 2011-205179 (Patent Literature 4)).

Unfortunately, the techniques disclosed in Patent Literatures 1 and 2 also involve the connector case tightened with the screws toward the pin insert from the exterior in the radial direction of the connector case. As a result, the connector pins are pulled in the axial directions of the screws. In other words, the displacement of the pin insert in the techniques disclosed in Patent Literatures 1 and 2 also causes no contact of the connector pins or no engagement in the connection between the male and female connectors.

In addition, the techniques disclosed in Patent Literatures 3 and 4 require an additional shielding component, such as a magnetic sheet for an electrostatic shield over the connector to therefore increase the numbers of the components and the assembly steps.

SUMMARY OF INVENTION

Technical Problem

It is an object of the present invention to provide a connector of a microphone with reduced displacement, such as eccentricity, of pins in the connector.

Solution to Problem

A connector of a microphone includes according to the present invention a cylindrical connector case having openings at both ends and a projection on an inner face thereof, two substrates having shapes fittable to the inner face of the cylindrical connector case, the substrates facing each other across the projection in the cylindrical connector case; and a connector pin extending through the substrates in the cylindrical connector case, having a contact that is electrically connected to another electronic device, and having a caulked portion fixed to one of the substrates on an opposite side to the contact.

Advantageous Effects of Invention

The present invention can prevent the displacement, such as eccentricity, of the connector pin.

DESCRIPTION OF EMBODIMENTS

A microphone, a connector of the microphone, and a method for manufacturing the connector of the microphone will now be described according to embodiments of the present invention.

[Microphone]

A microphone according to an embodiment of the present invention will now be described with reference to the accompanying drawings.

Figure 1:
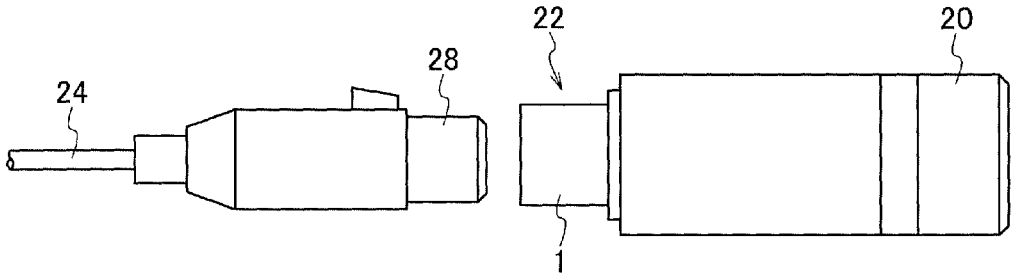
FIG. 1 is a side view illustrating a condenser microphone according to an embodiment of the present invention.

FIG. 1 is a side view illustrating a microphone according to the embodiment of the present invention. As illustrated in FIG. 1, the microphone 20 includes a connector 22 at the back end.

The connector 22 is attachable and detachable to a microphone cable connector 28 connected to one end of a microphone cable 24. The connector 22 in this embodiment is male while the microphone cable connector 28 is female.

The top end of the microphone cable connector 28 is inserted into a connector case 1 of the connector 22. The microphone cable connector 28 has a socket at the top end.

The connector 22 has a connector pin 2 engaged into the socket of the microphone cable connector 28 inserted into the connector case 1. The connector pin 2 is engaged into the socket to electrically connect the connector 22 to the microphone cable connector 28.

[Connector of Microphone]

The connector of the microphone according to an embodiment of the present invention will now be described with reference to the accompanying drawings.

Figure 2:
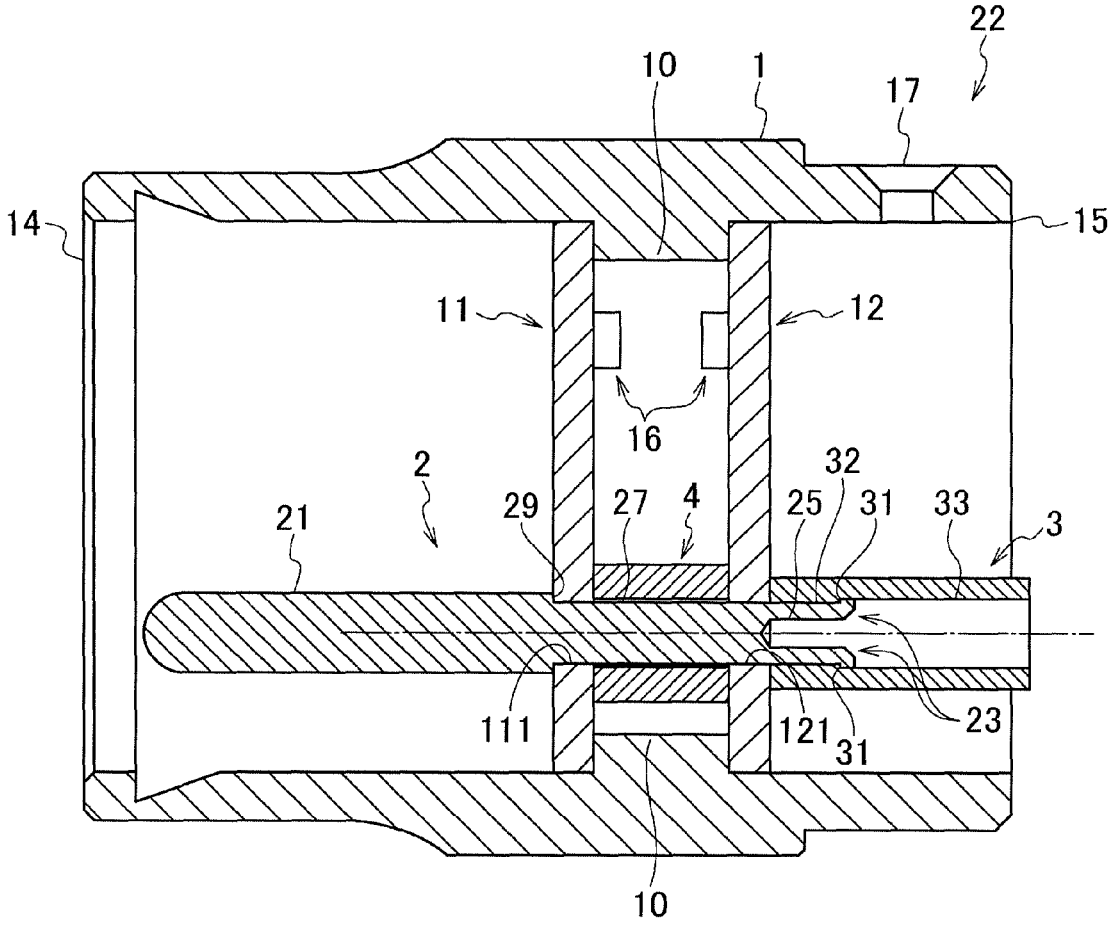
FIG. 2 is a longitudinal cross-sectional view illustrating a connector of the microphone according to the embodiment of the present invention.

FIG. 2 is a longitudinal cross-sectional view illustrating the connector of the microphone according to the embodiment of the present invention. As illustrated in FIG. 2, the connector 22 includes the cylindrical connector case 1. The connector case 1 is a hollow cylindrical connector 22 having two openings.

A first opening 14 has a shape fittable to the microphone cable connector 28. A second opening 15 is disposed on the opposite side to the first opening 14 of the connector case 1.

The connector case 1 has a projection 10 on the inner circumference. A first substrate 11 and a second substrate 12 are engaged to the projection 10. The projection 10 may be provided on the entire inner circumference of the connector case 1. Alternatively, projection fragments 10 may be provided so as to support at least several positions of each of the first and second substrates 11 and 12.

The connector case 1 has a screw hole 17 for fixing the connector 22 to the microphone 20 with a screw.

The first and second substrates 11 and 12 have shapes fittable to the inner face of the connector case 1. The shapes fittable to the inner face of the connector case 1 refer to shapes that are similar to or receivable in the interior of the connector case 1. The first and second substrates 11 and 12 are discs fittable to the inner face of the connector case 1. The first and second substrates 11 and 12 are discs having conductive patterns on both faces for implementing electronic circuits, for example, printed circuit boards (PCBs).

The first and second substrates 11 and 12 mounted in the connector case 1 have respective conductive patterns on their inner faces facing each other. The conductive patterns constitute a filter circuit for the microphone 20 in collaboration with electronic parts 16. The electronic parts 16 mounted on the inner faces of the first and second substrates 11 and 12 are, for example, zener diodes or capacitors.

Conductive patterns on the outer faces opposite to the respective inner faces of the first and second substrates 11 and 12 function as ground patterns. The ground patterns on the outer faces of the first and second substrates 11 and 12 mounted in the connector case 1 are grounded via the connector case 1. The electronic parts 16 mounted on the inner faces of the first and second substrates 11 and 12 are surrounded by the grounded conductive patterns and electrically shielded from the exterior.

The first and second substrates 11 and 12 mounted in the connector case 1 have through-holes 111 and 121 respectively for inserting the connector pin 2, on a common straight line in parallel to the central axis of the connector case 1. The numbers of the through-holes 111 and 121 correspond to the number (generally three) of the connector pins 2 in the connector 22.

An approximate half along the length of the connector pin 2 functions as a contact 21 electrically connected to the microphone cable connector 28. The residual half along the length of the connector pin 2 is a slim portion 27. The connector pin 2 has a step 29 between the contact 21 and the slim portion 27.

In the connector case 1, the slim portion 27 is inserted into the through-hole 111 of the first substrate 11 and the through-hole 121 of the second substrate 12 in this order from the first opening 14 along the length of the connector pin 2, i.e., along the central axis of the connector case 1. The connector pin 2 is fixed in the longitudinal direction by the contact of the step 29 in the connector pin 2 to the outer face of the first substrate 11.

Although only one connector pin 2 is illustrated in FIG. 2, any number of connector pins may be provided to the present invention.

A portion of the connector pin 2 adjacent to the first opening 14 functions as the contact 21 for electrical connection with the microphone cable connector 28. Another portion (on the other side) of the connector pin 2 adjacent to the second opening 15 functions as a caulked portion 23 fixed on the second substrate 12. The caulked portion 23 has a slit 25 along the length of the connector pin 2. The slit 25 facilitates expansion of the caulked portion 23 for the caulking.

As illustrated in FIG. 2, the caulked portion 23 projects from the outer face (at the right in FIG. 2) of the second substrate 12 through the through-hole 121 of the second substrate 12.

An engaged member 3 covering the caulked portion 23 of the connector pin 2 is engaged on the other side of the connector pin 2 extending through the first and second substrates 11 and 12. The engaged member 3 is engaged along the outer circumference of the caulked portion 23.

The engaged member 3 is a cylinder having a slim portion 32 and a thick portion 33, which are separated at a step 31 on the inner face. In the engaged member 3, the caulked portion 23 is caulked and engaged with the step 31.

The caulked portion 23 is caulked to fix the first and second substrates 11 and 12 to the connector case 1 between the steps 29 and 31 such that the projection 10 and a spacer 4 are held between the first and second substrates 11 and 12.

The engaged member 3 is fixed around the outer circumference of the connector pin 2, and one end of the engaged member 3 is in contact with the outer face of the second substrate 12.

The spacer 4 is disposed between the first and second substrates 11 and 12 through which the connector pin 2 extends.

The spacer 4 defines the distance between the first and second substrates 11 and 12 in the longitudinal direction in the connector case 1. The spacer 4 is a cylinder having a length corresponding to the defined distance. The spacer 4 fixes the connector pin 2 along its central axis in the connector case 1 in collaboration with the projection 10 of the connector case 1.

The spacer 4 also prevents the inclination of the first and second substrates 11 and 12 in the connector case 1.

The spacer 4 is a cylinder (ferrite bead) composed of, for example, ferrite. The spacer or ferrite bead 4 functions as a self-inductance component (inductor) of a filter circuit due to a current flowing through the connector pin 2 extending through the spacer 4.

Figure 3:
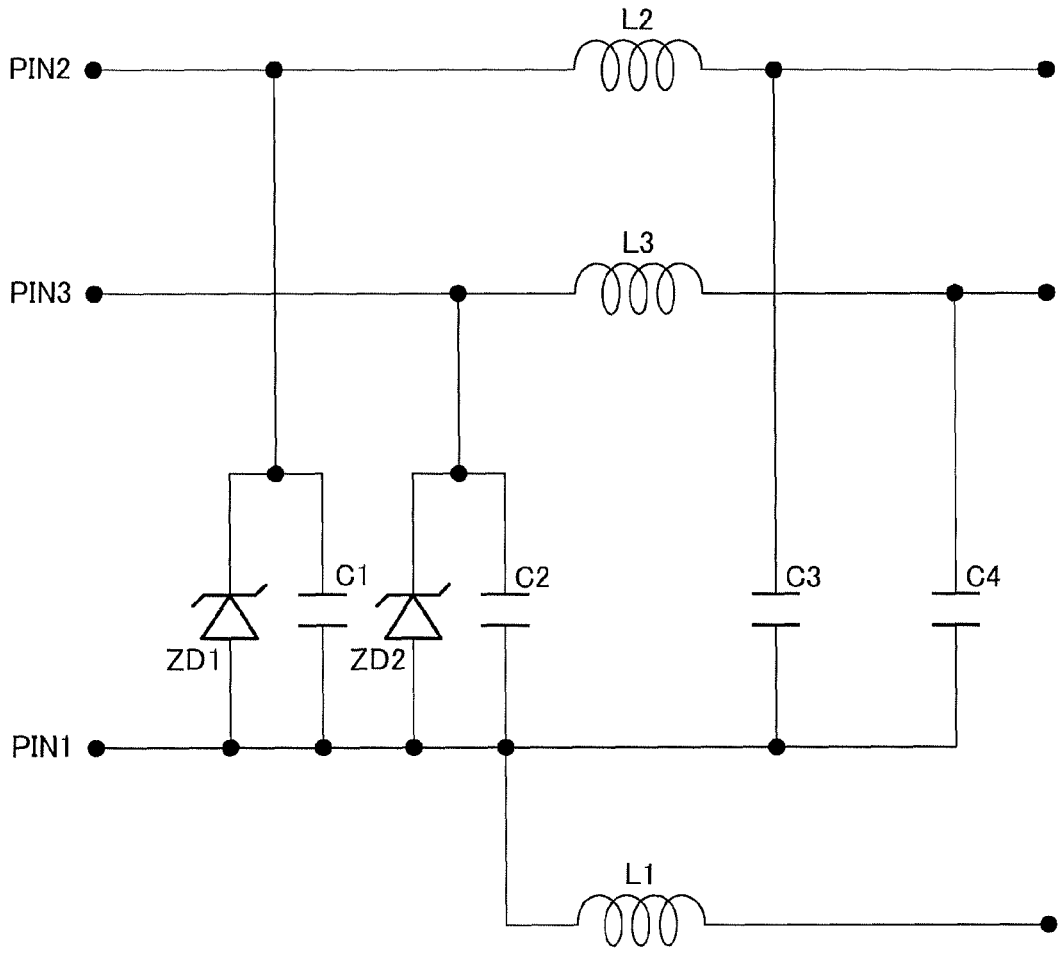
FIG. 3 is a circuit diagram illustrating a filter circuit in the connector of the microphone in FIG. 2.

FIG. 3 is a circuit diagram illustrating a filter circuit in the connector 22 of the microphone in FIG. 2. FIG. 3 exemplifies three connector pins 2 (PIN1, PIN2, and PIN3) in the connector 22.

As illustrated in FIG. 3, the connector 22 is a three-pin microphone connector including pins PIN1, PIN2, and PIN3. The connector 22 can have a ground pin PIN1, and a hot pin PIN2 and a cold pin PIN3 of a balanced output.

In the filter circuit, a zener diode ZD1 is connected to a capacitor Cl in parallel between the pins PIN1 and PIN2. In the filter circuit, a zener diode ZD2 is connected to a capacitor C2 in parallel between the pins PIN1 and PIN3.

In the filter circuit, a capacitor C3 is connected between the pins PIN1 and PIN2. In the filter circuit, a capacitor C4 is connected between pins PIN1 and PIN3. In the filter circuit, a coil L1 is connected to the pin PIN1.

The filter circuit has an inductor L2 since the connector pin 2 (PIN2) is inserted into the spacer or ferrite bead 4. The filter circuit similarly has an inductor L3 since the connector pin 2 (PIN3) is inserted into the spacer or ferrite bead 4.

The capacitors C1, C2, C3, and C4, the inductors L1, L2, and L3, and the zener diodes ZD1, and ZD2 constitute a filter circuit (low-pass filter circuit) for an electrostatic shield. The filter circuit is disposed on the respective inner faces of the two circuit substrates (the first and second substrates 11 and 12) to be shielded from the exterior. This configuration can enhance the filtering effect.

As described above, the first and second substrates 11 and 12 can be aligned in the connector 22 while the electronic parts 16, such as zener diodes can be protected from an overcurrent flowing from the connector pin 2.

[Method for Manufacturing Connector]

A method for manufacturing the connector 22 will now be described.

Figure 4:
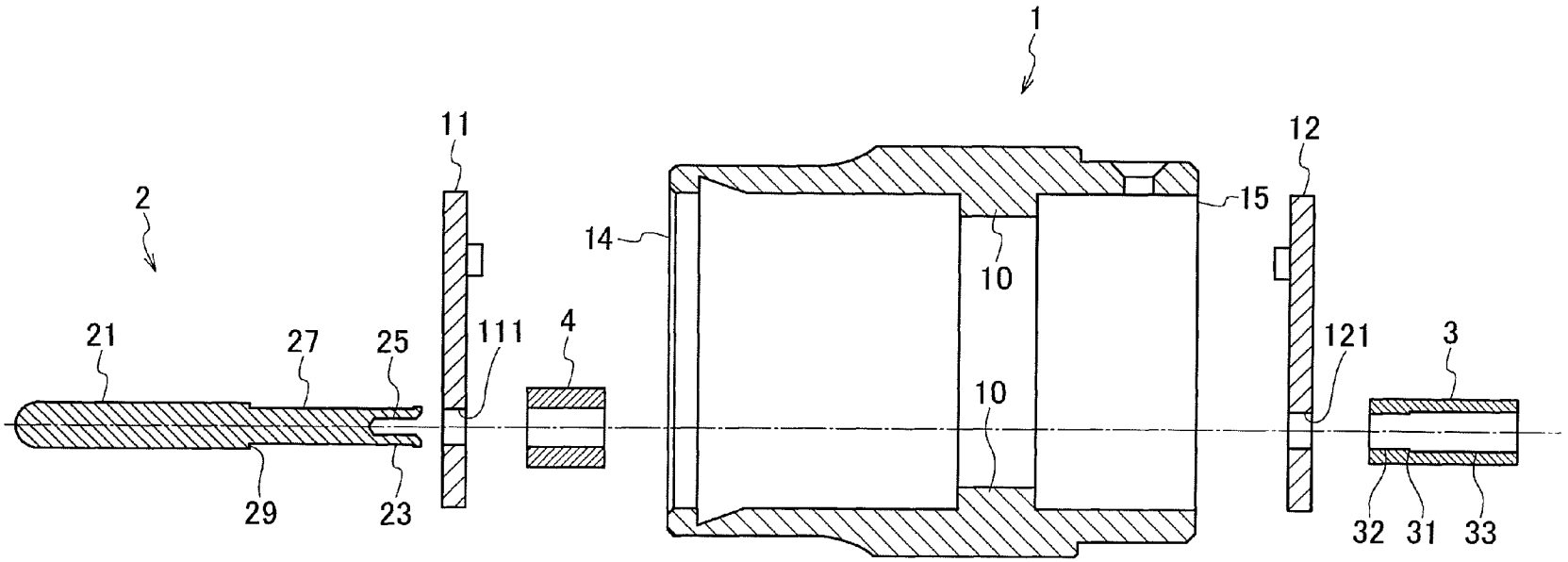
FIG. 4 is an exploded longitudinal cross-sectional view of the connector of the microphone in FIG. 2.

FIG. 4 is an exploded longitudinal cross-sectional view of the connector 22. As illustrated in FIG. 4, the connector 22 is assembled through steps for assembling the spacer 4, the first substrate 11, and the connector pin 2 in this order from the first opening 14 of the connector case 1. In the next step, the second substrate 12 and the engaged member 3 are assembled in this order from the second opening 15.

These assembling steps are performed by aligning the through-hole 111 of the first substrate 11, the through-hole 121 of the second substrate 12, the spacer 4, and the connector pin 2.

Figure 5:
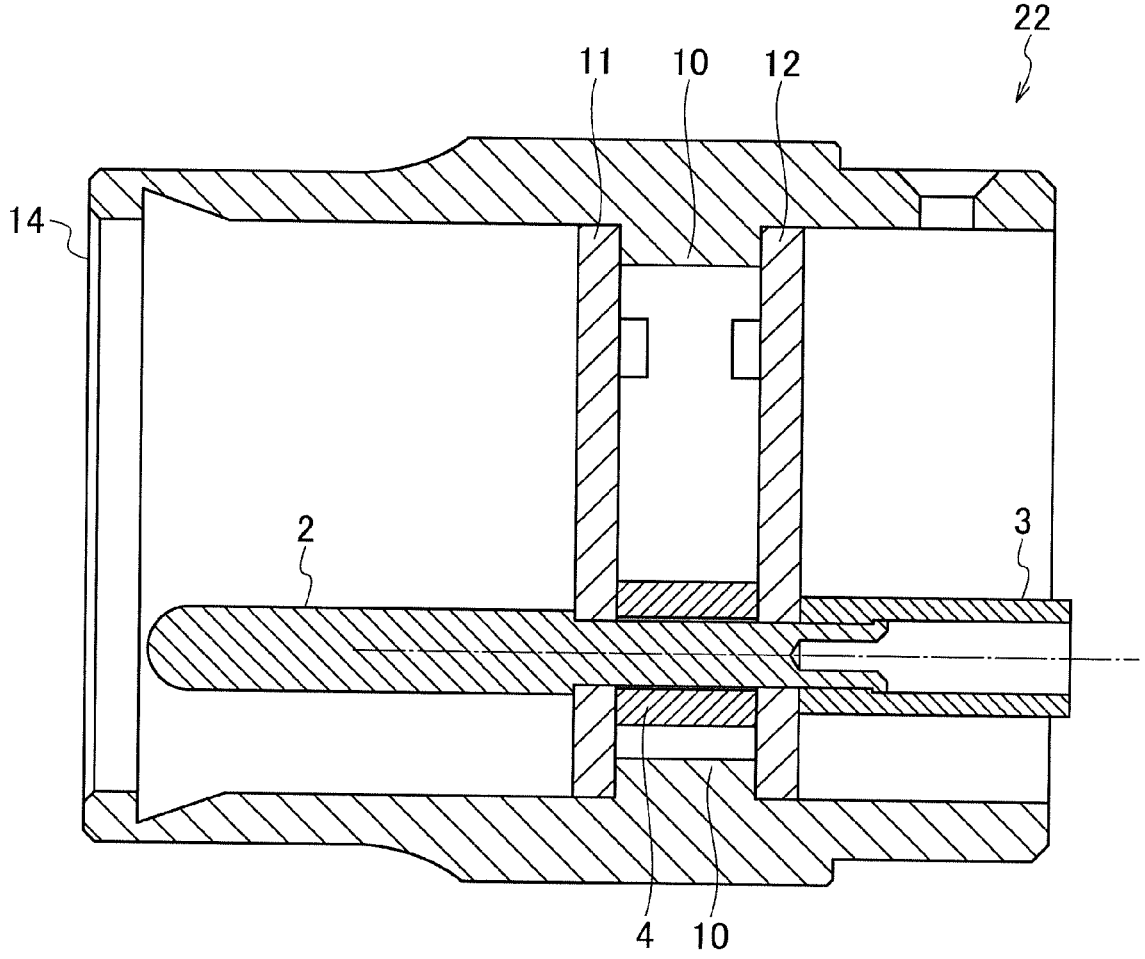
FIG. 5 is a longitudinal cross-sectional view illustrating a connector pin assembled in the connector of the microphone in FIG. 2.

FIG. 5 is a longitudinal cross-sectional view illustrating the connector pin 2 assembled in the connector 22. As illustrated in FIG. 5, the first and second substrates 11 and 12 are certainly aligned by the projection 10 and the spacer 4 in assembling the first and second substrates 11 and 12 and the connector pin 2 in the connector case 1.

In other words, since the projection 10 and the spacer 4 prevent the inclination and eccentricity of the connector pin 2 attached to the first and second substrates 11 and 12 in the connector 22, the connector pin 2 is not misaligned.

Figure 6:
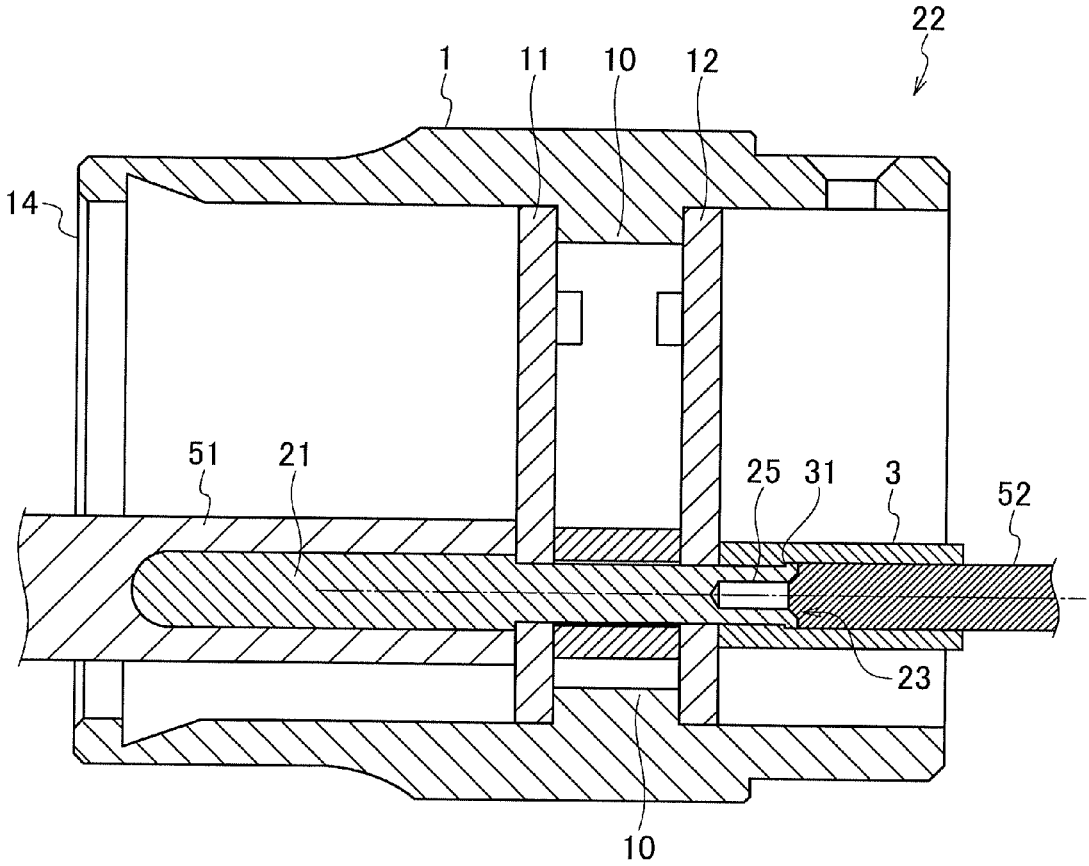
FIG. 6 is a longitudinal cross-sectional view illustrating steps for caulking the connector pin in the connector of the microphone in FIG. 2.

FIG. 6 is a longitudinal cross-sectional view illustrating steps for caulking the connector pin 2. As illustrated in FIG. 6, the caulked portion 23 is caulked while the contact 21 is covered with a first jig 51 to prevent the connector pin 2 from moving toward the first opening 14 in the longitudinal direction.

In this state, a second jig 52 is inserted toward the caulked portion 23 in the longitudinal direction from the second opening 15 to caulk and join the second substrate 12, the caulked portion 23, and the engaged member 3. When the second jig 52 is pressed, the tapered tip of the second jig 52 bites into the inner circumference of the caulked portion 23 to spread the caulked portion 23. As a result, the caulked portion 23 bites into the step 31 of the engaged member 3. In this way, the caulked portion 23 is engaged with the step 31 of the engaged member 3 to certainly fix the connector pin 2.

[Advantageous Effects of Embodiment]

As described above, the microphone 20 and the connector 22 according to the present embodiment have the following advantageous effects.

According to the microphone 20 and the connector 22, the inner shape of the connector case 1 and the projection 10 can readily fix the first and second substrates 11 and 12 in the longitudinal direction without misalignment of the connector pin 2.

According to the microphone 20 and the connector 22, the spacer 4 disposed between the first and second substrates 11 and 12 can readily fix the first and second substrates 11 and 12 and the connector pin 2.

According to the microphone 20 and the connector 22, the connector pin 2 can be fixed to the second substrate 12 by the caulked portion 23 to readily fix the first and second substrates 11 and 12 to the connector case 1.

According to the microphone 20 and the connector 22, the conductive patterns on the outer faces of the first and second substrates 11 and 12 can function as electrostatic shields to prevent noise caused by a high frequency current through the connector 22.

According to the microphone 20 and the connector 22, the spacer 4 through which the connector pin 2 extends is a ferrite bead which can function as a filter circuit for an electrostatic shield right near the connector pin 2. According to this configuration, the microphone 20 and the connector 22 can effectively protect the internal transmission path from exogenous noise.

As described above, the method for manufacturing the connector of the microphone according to the present embodiment can produce high-quality connectors with high productive efficiency and a high yield rate.

What is claimed is:

1. A microphone connector comprising:

a cylindrical connector case having openings at both ends and a circumferential projection on an inner face thereof;

two substrates having shapes fittable to the inner face of the cylindrical connector case, the substrates facing each other across the circumferential projection in the cylindrical connector case; and a connector pin extending through the substrates in the cylindrical connector case, having a contact that is electrically connected to a microphone cable connector, and having a caulked portion fixed to one of the substrates on an opposite side to the contact and a cylindrical engaged member engaged with the caulked portion.

2. The microphone connector according to claim 1, wherein the substrates are attached to the cylindrical connector case by engagement to the projection.

3. The microphone connector according to claim 1, wherein the caulked portion has a slit extending along a length of the connector pin.

4. The microphone connector of the microphone according to claim 1, wherein the cylindrical engaged member has a step on an inner face thereof, and the caulked portion is engaged with the step.

5. The microphone connector according to claim 1, wherein the substrates face each other at a predetermined distance along a length of the cylindrical connector case.

6. The microphone connector according to claim 1, wherein electronic parts are mounted on respective inner faces facing each other of the substrates.

7. The microphone connector according to claim 1, wherein conductive pattern are provided on respective outer faces of the substrates.

8. The microphone connector according to claim 1, further comprising at least one additional connector pin.

9. A microphone comprising the connector according to claim 1 at a back end thereof.

10. The microphone connector according to claim 1, wherein the circumferential projection is provided on an entire inner circumference of the cylindrical connector case.

11. The microphone connector according to claim 1, wherein the circumferential projection is divided into multiple projection fragments so as to support at least several positions of each of the two substrates.

12. The microphone connector according to claim 1, wherein the connector pin extends through a spacer between the substrates.

13. The microphone connector according to claim 12, wherein the spacer is a ferrite bead.

14. The microphone connector according to claim 13, wherein the ferrite bead is engaged around an outer circumference of the connector pin and functions as a filter circuit in collaboration with the connector pin and electronic parts.

15. A method for manufacturing a microphone connector, the method comprising;

(A) engaging two substrates with a circumferential projection provided on an inner face of a cylindrical connector case having openings at both ends, the substrates having shapes fittable to the inner face of the cylindrical connector case and facing each other across the circumferential projection;

(B) inserting a connector pin haying a contact electrically connected to a microphone cable connector and a caulked portion on an opposite side to the contact, into through-holes provided at common positions of the substrates; and (C) spreading the caulked portion to fix the connector pin with the substrates; and engaging an engaged member around an outer circumference of the caulked portion and spreading the caulked portion in the engaged member to bite the caulked portion into the engaged member.

16. The method for manufacturing the microphone connector according to claim 15, wherein step (C) comprises biting the caulked portion of the connector pin into the engaged member while pressing one end of the engaged portion against an outer face of one of the substrates.

* * * * *